US008353515B2

(12) United States Patent
Cheng et al.

(10) Patent No.: US 8,353,515 B2
(45) Date of Patent: Jan. 15, 2013

(54) PYRAMID GAME

(76) Inventors: Wei Chuan Cheng, Singapore (SG); Chiat Jin J Lee, Singapore (SG); Jasmine Hannah Sze En Lee, Singapore (SG); Jeanette Faith Sze Yee Lee, Singapore (SG)

( * ) Notice: Subject to any disclaimer, the term of this patent is extended or adjusted under 35 U.S.C. 154(b) by 0 days.

(21) Appl. No.: 12/805,762

(22) Filed: Aug. 19, 2010

(65) Prior Publication Data

US 2012/0043718 A1 Feb. 23, 2012

(51) Int. Cl.
*A63F 3/00* (2006.01)

(52) U.S. Cl. ..... 273/241; 273/287

(58) Field of Classification Search ..... 273/241, 273/280, 287
See application file for complete search history.

(56) References Cited

U.S. PATENT DOCUMENTS

| | | | | | |
|---|---|---|---|---|---|
| 2,873,975 | A | * | 2/1959 | Haws | 273/241 |
| 3,025,063 | A | | 3/1962 | Magee | |
| 3,030,112 | A | * | 4/1962 | Scharp | 273/241 |
| 3,371,931 | A | * | 3/1968 | Saunders | 273/249 |
| D215,103 | S | | 9/1969 | Stevens | |
| 3,643,957 | A | | 2/1972 | Bryant | |
| 3,706,456 | A | | 12/1972 | Sesti et al. | |
| 3,809,407 | A | * | 5/1974 | Quigley | 273/241 |
| 4,082,283 | A | | 4/1978 | La Ferla et al. | |
| 4,124,212 | A | | 11/1978 | Normart | |
| 4,147,359 | A | * | 4/1979 | King | 273/241 |
| 4,194,741 | A | | 3/1980 | Rea | |
| 4,223,892 | A | * | 9/1980 | Matherne | 273/248 |
| D259,644 | S | | 6/1981 | Israel et al. | |
| D261,781 | S | * | 11/1981 | Keltner | D21/336 |
| 4,477,080 | A | * | 10/1984 | Baker | 273/241 |
| 4,653,759 | A | | 3/1987 | Anderson et al. | |
| 4,666,162 | A | * | 5/1987 | Campbell | 273/249 |
| 5,004,245 | A | * | 4/1991 | Schumacher et al. | 273/241 |
| D328,475 | S | | 8/1992 | Gould et al. | |
| D381,370 | S | * | 7/1997 | Hansen et al. | D21/336 |
| 5,660,388 | A | * | 8/1997 | Benn | 273/241 |
| 5,662,329 | A | * | 9/1997 | Nason | 273/261 |
| 6,419,228 | B1 | | 7/2002 | Egli et al. | |
| 6,523,827 | B1 | | 2/2003 | Watson | |
| 6,581,933 | B1 | | 6/2003 | Zivan | |
| D525,314 | S | | 7/2006 | Elkhoury | |
| 2004/0135314 | A1 | | 7/2004 | Peterson | |
| 2006/0145422 | A1 | | 7/2006 | Balanzategui | |
| 2008/0197567 | A1 | | 8/2008 | Balanzategui | |

FOREIGN PATENT DOCUMENTS

| | | |
|---|---|---|
| BR | 8605238 | 10/1988 |
| DE | 39 05 501 | 8/1990 |
| DE | 20 2007 002 247 | 5/2007 |
| GB | 2 124 091 | 2/1984 |
| GB | 2 142 548 | 1/1985 |
| GB | 2 228 422 | 8/1990 |

* cited by examiner

*Primary Examiner* — Vishu K. Mendiratta
(74) *Attorney, Agent, or Firm* — Dennison, Schultz & MacDonald

(57) ABSTRACT

A three-dimensional game shaped as a pyramid or prism with four or more faces, in which each face has nine terraced levels that attenuate to the peak of the pyramid. Each level has a plurality of circular depressions for the placement of each player's playing pieces. The corresponding level of each face has the same number of circular depressions, and each consecutive higher level has two fewer depressions than its immediate lower level. The peak of the pyramid is truncated and has a single circular depression. The peak can only be occupied by one playing piece at a time.

18 Claims, 6 Drawing Sheets

FIG. 2
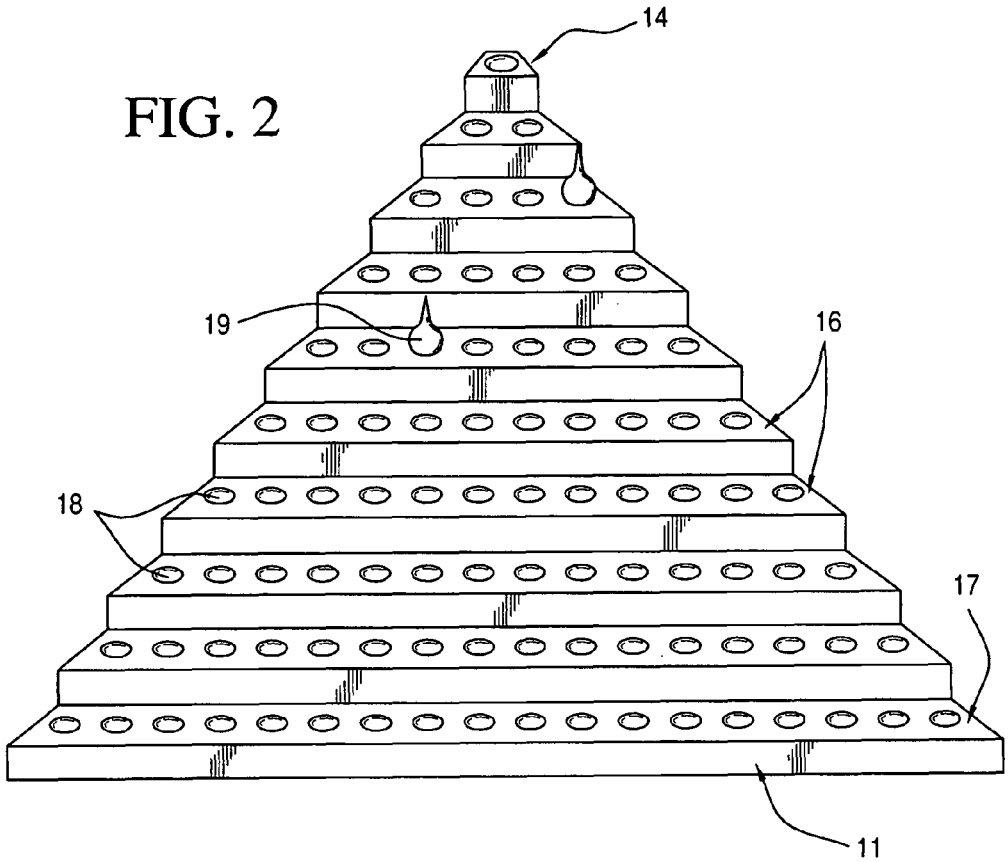
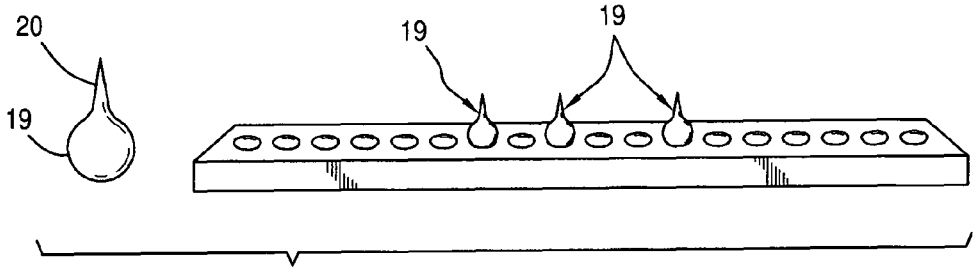
FIG. 2A
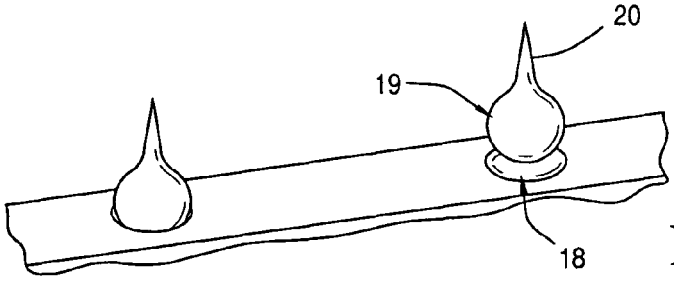
FIG. 3

PYRAMID GAME

FIELD OF THE INVENTION

The present invention relates to a game played on a three-dimensional pyramid or prism with playing pieces that move up and down the faces of the pyramid or prism according to certain rules.

BACKGROUND OF THE INVENTION

Many games involving a pyramid or prism either represent the pyramid or prism in a two-dimensional form and/or do not use the distinctive shape of the pyramid or prism to require the movement of the playing pieces up and down their faces, i.e. to bring all the different players' playing pieces to move up the respective faces of the pyramid/prism and converge on a focal point at the peak, and then down the various remaining faces.

U.S. Pat. No. 5,004,245 discloses a multi-level pyramid board game wherein dice are used to determine an amount of movement upon the board, as well as the direction of movement of the playing pieces. The direction of play is from the base of the pyramid, and terminates at the apex thereof.

U.S. Pat. No. 5,660,388 discloses a board game comprising a game board marked into a matrix of spaces forming a plurality of concentric perimeters, the innermost perimeter surrounding a central space.

None of the existing games provide the plurality of movement and multiple points of conflict among the various players' playing pieces along the entire pathway for the playing piece that, in the present game, results in a particular playing piece being kicked out of the pathway and to have to restart its path again.

By means of cards drawn by the players, the present invention allows players to strategize the use of immunity against such kick-outs, and the use of counter-immunity to neutralize immunity advantage. None of the games provide these playing rules, nor the fast-changing fortunes of the players and the unpredictability and fast-moving pace as well as strategy, as in the present invention.

Unlike the present invention, many games only involve the peak as the destination or completion of the journey for the playing pieces.

Some of the games also involve concentric pathways that do not depend on the shape of the pyramid or prism. The present invention's rules and manner of play, and its unpredictability emerge from the shape of the pyramid or prism.

None of the prior art games has rules according to that of the present invention, nor of the goals thereof.

BRIEF SUMMARY OF THE INVENTION

A game apparatus including a three-dimensional pyramid or prism with at least four equal faces, each optionally marked in a separate color, and a plurality of playing pieces divided into a number of groups equal to the number of pyramid faces and a plurality of cards equal in number and divided into groups equal to the number of pyramid faces, and a conventional six-sided die having from one to six pips.

The number of playing pieces in each group is equal to the number of pyramid faces less one. Each group of playing pieces and cards is distinguished by a color corresponding to the colors of the pyramid/prism faces.

Each player selects a color and is assigned the playing pieces of the same color, and randomly draws an equal number of cards that is less than the total number of cards from the group of cards bearing the same color.

It is an object of this invention for each player to move his playing pieces from the lowest level of a pyramid face allocated to him to rest on the pyramid peak. Each playing piece is then moved down one of the remaining pyramid faces to the lowest level of the pyramid face, so that each of the remaining pyramid faces will have one playing piece of the same color.

Each playing piece is moved based on the roll of the die, and reaching the peak or the lowest of a descending pyramid face is based on an exact roll of the die. A larger number on the die means that the playing member bounces backwards after reaching the peak or the lowest level. All movements are forwards, and backwards movements are allowed on bouncing back. Cards drawn randomly by players may be used to allow backwards or sideways movements. The player whose playing members come to rest on the lowest level of each of the remaining pyramid faces is the winner.

BRIEF DESCRIPTION OF THE SEVERAL VIEWS OF THE DRAWINGS

These and other objects of the present invention will be appreciated and understood by those skilled in the art from the detailed description of the preferred embodiments of the invention and the following drawings of which:

FIG. 2 is a perspective view of a portion of a pyramid/prism face and two ascending playing pieces and the depressions indicating the places where the playing pieces can move and rest.

FIG. 2A is a perspective view of a playing piece (left) and three playing pieces resting in depressions (right).

FIG. 3 is a perspective view of a playing piece and the depression into which the playing piece fits.

DETAILED DESCRIPTION OF THE INVENTION

The Game Board

Figure 1:
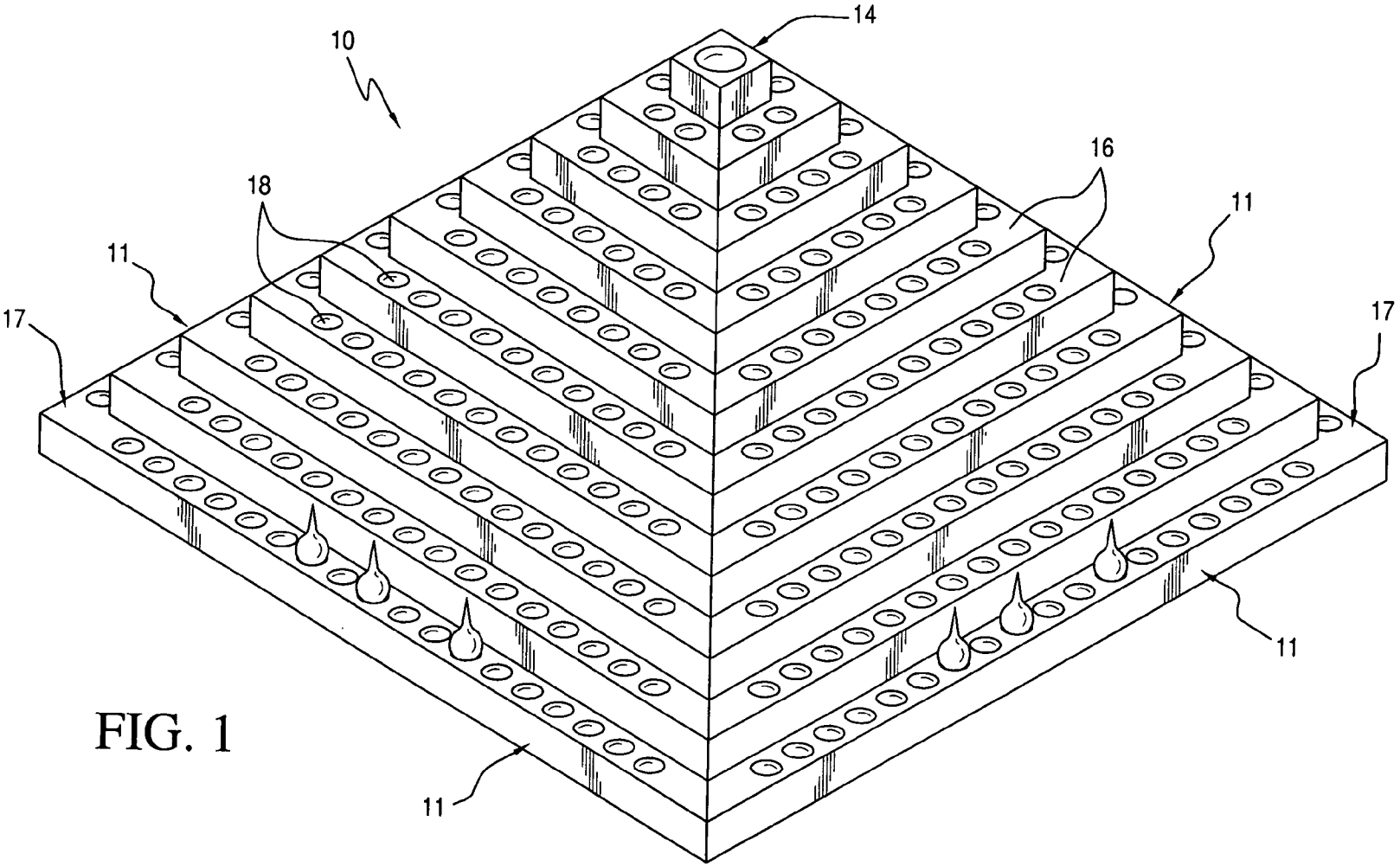
FIG. 1 is a perspective view of the two sides of the three-dimensional pyramid or prism with its playing pieces, showing the situation of the playing pieces for these two sides at the beginning of the game.

Referring now to the drawings, wherein the showings are for the purpose of illustrating the preferred embodiment of the invention only, and not for the purpose of limiting the same, the game board of the present invention, in its preferred embodiment, is shown in FIG. 1 and indicated by the reference numeral 10.

Figure 10:
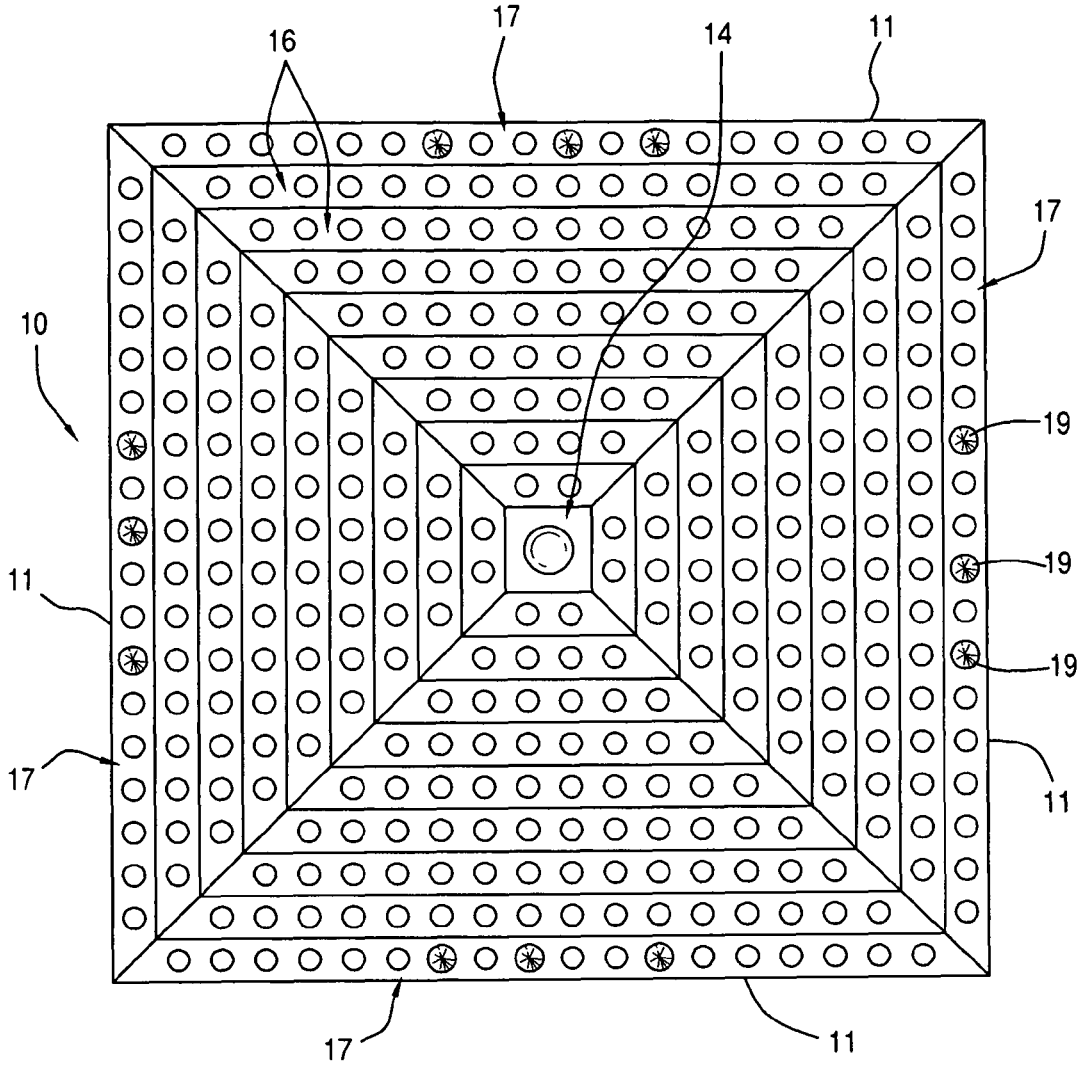
FIG. 10 is a plan view of the three-dimensional pyramid or prism.

Referring to FIGS. 1 and 10, the game board 10 is a three-dimensional pyramid or prism with four equal faces 11 or sides, and a square base. In alternative embodiments of the present invention, the pyramid has five or six equal faces or sides. The number of faces 11 determines the number of players, so that with a four-sided pyramid there will be four players, with a five-sided pyramid, five players, and so on.

Another embodiment of the present invention is a conical shape, with the wider circular end as the base, and the tip of the cone truncated to provide a flat surface for a playing piece to rest.

Each face 11 of the pyramid has nine terraced levels 16, not including the truncated peak 14. The lowest terraced level 17 of each face corresponds in height to the lowest terraced level 17 of the other faces 11. Each correspondingly higher terraced level of each face corresponds in height to the correspondingly higher terraced level of the other faces. The height of each level of each face should be the same and the width of each level should be the same as each other. The top of the pyramid is a truncated level plane comprising only a single circular depression 18 to hold one playing piece.

The terraced levels 16 for each face 11 comprise depressions 18, which in a preferred embodiment are circular. The lowest terraced level 17 for each face 11 comprises eighteen depressions 18. The next higher level comprises two less circular depressions, and each higher terraced level has two less circular depressions, until at the highest level (immediately below the truncated peak), where there are only two circular depressions. Each of the depressions 19 on a lower level is arranged directly behind another depression 18 on the immediate next higher level, except for the additional two depressions on the lower level, each of which occupies one of the extended ends of the lower level.

Referring now to FIG. 2, the playing pieces 19 of each player are preferably shaped as tear drops, each with an elongated tip 20 for an easy hold. The number of playing pieces 19 per player is equal to the number of sides 11 of the pyramid or prism, less one. The playing pieces 19 of each player are distinguished by color code, each player having one set of playing pieces 19 with one color. Each player is assigned a face 11 of the pyramid and there may be a maximum of players equal to the number of the faces 11 of the pyramid.

FIG. 2A shows the initial arrangement of each player's playing pieces on the lowest terraced level 17 of the face 11 of the pyramid assigned to him before the commencement of play. All players must have their respective playing pieces 19 all arranged in the same way on their own assigned face 11 of the pyramid before the commencement of play.

To determine which of the players goes first, each player rolls one die. The number of pips on the die indicates the number. The player who rolls the die with the highest number of pips is the first to go, and the other player to his left is the next to roll the die, and so on, in a counterclockwise manner.

In accordance with the rules of the game, each player in his turn throws the die and, based on the number of pips rolled on the die, will move any one, but not more than one playing piece 19 based on the number rolled. The player has complete discretion which of his playing pieces he wishes to move in one turn.

The object of the game is for each player to move all of his playing pieces 19 up his assigned pyramid face 11 to rest on the truncated peak 14, and then to move each of his playing pieces 19 down the remaining faces of the pyramid, so that each of the remaining faces will have only one playing piece 19 of the particular player that is resting on the lowest level of the respective remaining face. There is no order in which the player may move his playing pieces 19 and there is no rule that all his playing pieces must clear the peak before he can move them down the peak.

A playing piece resting on the single depression 18 of the truncated peak 14 is defined herein as a "peak playing piece".

Figure 4:
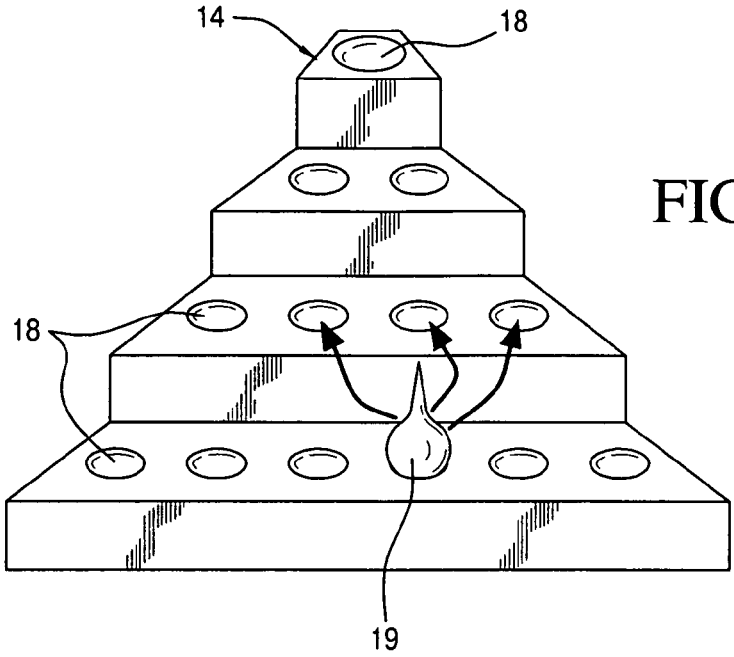
FIG. 4 is a perspective view of a portion of a pyramid face and a playing piece, illustrating the possible movements of the playing piece when ascending the face of the pyramid.
Figure 5:
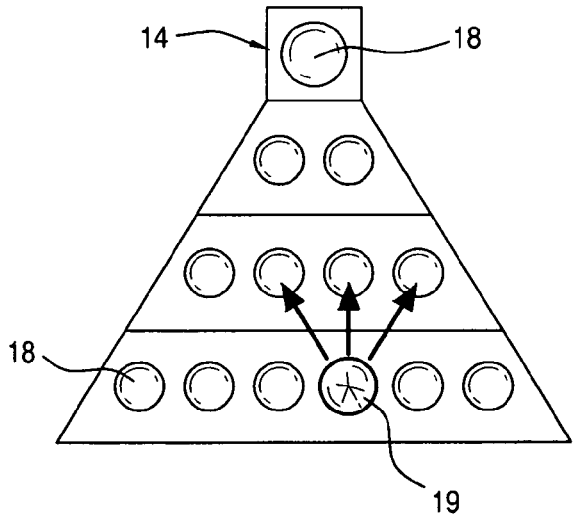
FIG. 5 is a plan view of a portion of a pyramid face and the truncated peak, and a playing piece, illustrating the possible movements of the playing piece when ascending the face of the pyramid.

A player in his turn moves his chosen playing piece 19 up his assigned pyramid face 11 by the number of spaces indicated by the depressions, according to the number of pips on the rolled die. Now referring to FIGS. 4 and 5, for each step, the ascending playing piece 19 may only move in the manner indicated, i.e. to move only forwards and upwards to the depression directly in front of or diagonal to the depression from where it moves. Alternatively, or in addition to the roll of the die, the playing piece 19 may be moved based on the directions from one of the player's randomly drawn cards. The player may, but is not obligated to use his cards.

To reach the truncated peak 14, the player has to move his chosen playing piece 19 by the exact number of depressions 18 equal to the number of pips on the rolled die. Alternatively, or in addition to the roll of the die, the playing piece 19 may be moved based on the directions from one of the player's randomly drawn cards. The player may, but is not obligated to use his cards. If the number of pips exceeds the number of depressions to reach the truncated peak 14, the movement of the playing piece will be as shown in FIG. 6, i.e. the playing piece moves backwards from the truncated peak by the excess number.

Figure 6:
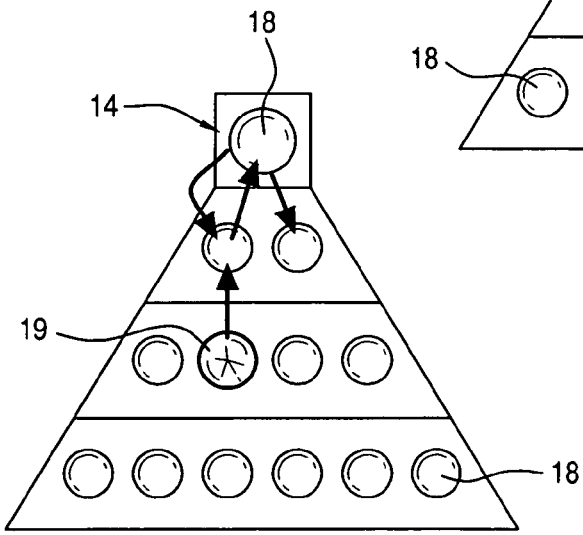
FIG. 6 is a plan view of a portion of a pyramid face and the truncated peak, and a playing piece, illustrating the possible movements of the playing piece when ascending and bouncing back from the truncated peak.

Referring now to FIG. 6, for each step, a playing piece 19 moving backwards may only move in the manner indicated, i.e. to move only downwards to the depression directly in front of or diagonal to the depression from where it moves. Alternatively, the player may choose to move another playing piece.

A playing piece 19 at the peak 14 may be knocked off by another playing piece 19 that reaches the peak 14 by the exact number of depressions and equal to the number of pips on the rolled die. A knocked-off peak playing piece is returned to the lowest level 17 of the pyramid face 11 which the same playing piece 19 had been ascending. The player is free to place the playing piece on any depression of the lowest level 17 of such pyramid face 11. A variation would be to place the playing piece 19 only on allocated depressions on such lowest level 17. A peak playing piece 19 is not knocked off where another playing piece 19 reaches the peak 14 and then has to move backwards, based on the number of pips on the rolled die.

A peak playing piece may only descend after having rested on the peak 14 after the other players with at least one playing piece 19 that can be moved have had their turn once. The relevant player may choose at his or her discretion not to move his or her peak playing piece, and chose to move another playing piece.

On choosing a peak playing piece to descend, the player must choose any one of the pyramid faces 11 (other than the one up which the playing piece had ascended), provided that such chosen pyramid face 11 does not already have another descending playing piece belonging to the same player.

Figure 7:
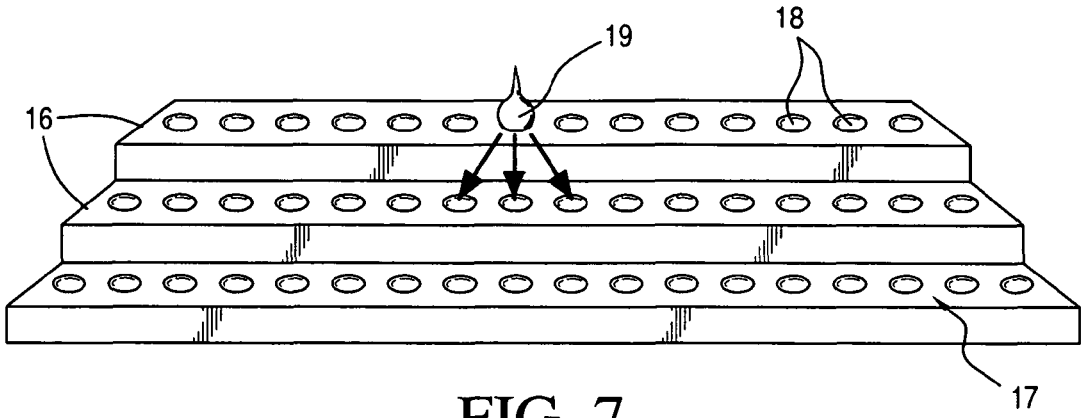
FIG. 7 is a perspective view of a portion of a pyramid face and a playing piece, illustrating the possible movements of the playing piece when descending the face of the pyramid.
Figure 8:
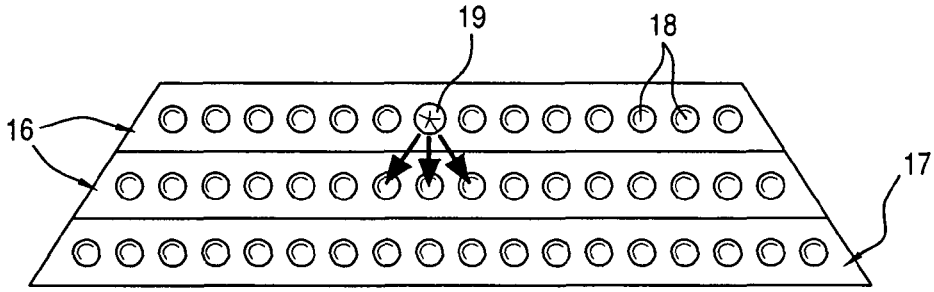
FIG. 8 is a plan view of a portion of a pyramid face, and a playing piece, illustrating the possible movements of the playing piece when descending the face of the pyramid.

Referring to FIGS. 7 and 8, for each step, a descending playing piece 19 may only move in the manner indicated, i.e. to move only downwards to the depression directly in front of or diagonally to the depression from where it moves.

Alternatively, or in addition to the roll of the die, the playing piece 19 may be moved based on the directions from one of the player's randomly drawn cards. The player may, but is not obligated to use his cards.

A descending playing piece may knock off an ascending playing piece of another player, or another descending playing piece of another player, where the first-mentioned descending playing piece moves to the same depression occupied by the ascending or other descending playing piece based on an exact roll of the die. Similarly, an ascending playing piece may knock off any playing piece on the same pyramid face in the same manner.

A knocked-off ascending or descending playing piece is returned to the lowest level 17 of the pyramid face 11 which the same playing piece 19 had been ascending. The player is free to place the knocked-off playing piece on any depression 18 of the lowest level 17 of such pyramid face 11. A variation would be to place the playing piece 19 only on allocated depressions 18 on such lowest level 17.

Figure 11:
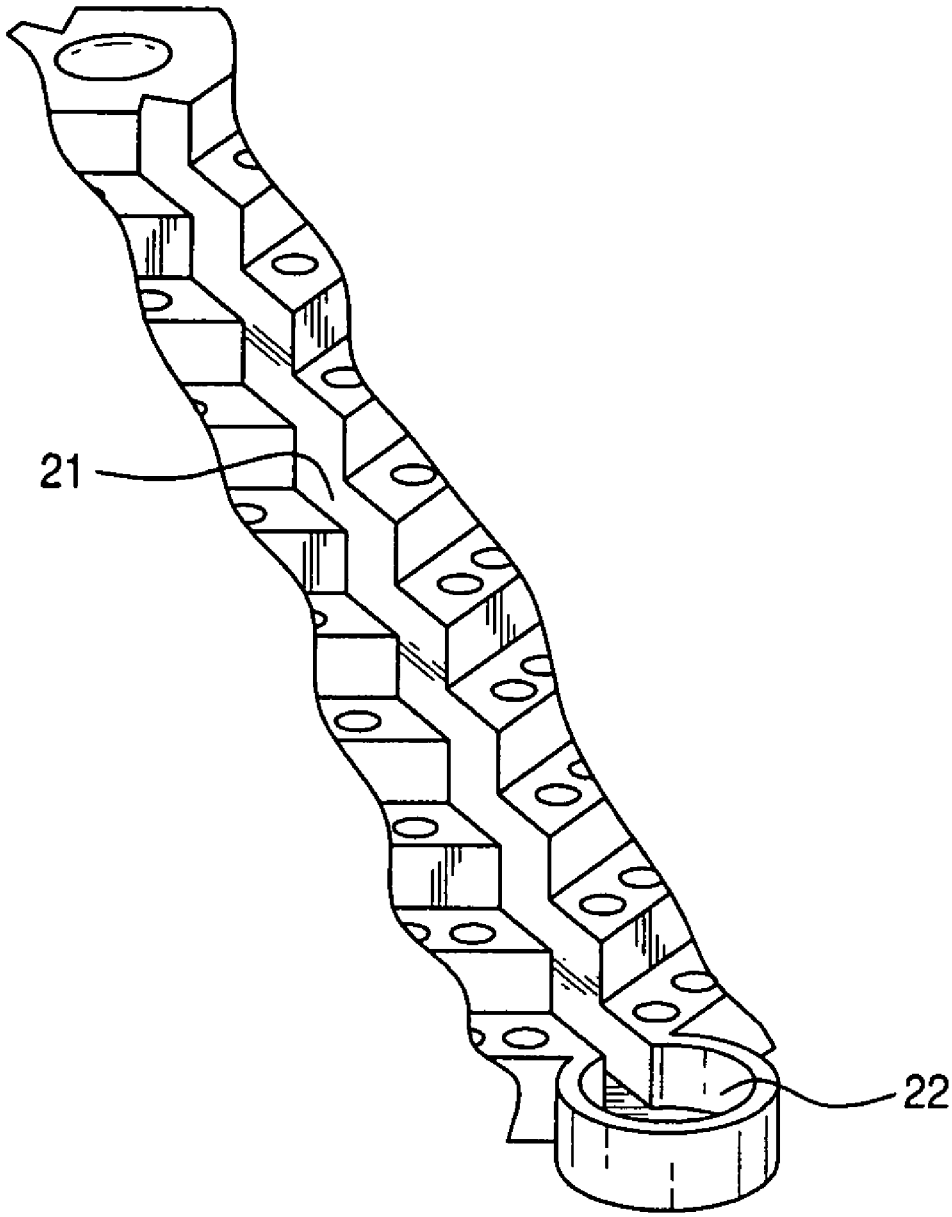
FIG. 11 is a perspective view of a portion of one corner of two adjoining faces, in an embodiment of the invention.

Referring now to FIG. 11, in another variation of the game, the game board comprises troughs or channels 21 separating any two adjacent sides 11 of the pyramid/prism, and a receptacle 22 at the lower end of the troughs 21. The troughs 21 extend from a corner of the truncated peak 14 of the pyramid/prism to a base corner of the pyramid/prism. When an ascending or descending playing piece is knocked off, the player knocking the knocked off playing piece picks up the piece and allows the piece to slide down one of the two troughs 21 that are adjacent the pyramid face of the player owning the knocked-off piece, and into the receptacle 22. The player owning the knocked-off piece then retrieves the playing piece and the piece is then played as described herein.

To reach the lowest level 17 of the pyramid face 11 down which a playing piece 19 is descending, the playing piece 19 must move by the exact number of depressions 18 according to the number of pips on the rolled die. Alternatively, or in addition to the roll of the die, the playing piece 19 may be moved based on the directions from one of the player's randomly drawn cards. The player may, but is not obligated to use his cards.

Figure 9:
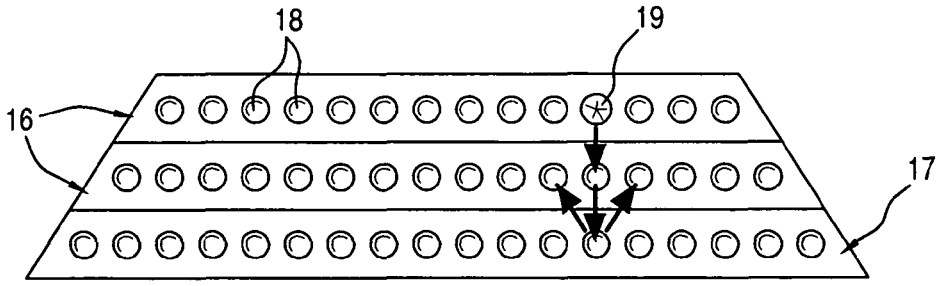
FIG. 9 is a plan view of a portion of a pyramid face and a playing piece, illustrating the possible movements of the playing piece when descending and bouncing back from the base of the pyramid.

If the number on the thrown die exceeds the exact number of moves to reach the lowest level 17, the movement of the playing piece 19 will be as shown in FIG. 9, i.e. the playing piece 19 moves backwards and upwards from the lowest level 17 by the excess number. Referring to FIG. 9, for each step, a playing piece 19, so moving backwards in this manner, may only move in the manner indicated, i.e. to move only backwards to the depression directly in front of or diagonal to the depression from where it moves. Alternatively, the player may choose to move another playing piece 17.

A playing piece 19 that moves backwards from the truncated peak 14 or from the lowest level 17 due to an excess number of pips on the rolled die, may knock off another playing piece 19 if the first-mentioned playing piece moves backwards and lands on the same depression 18 as such other playing piece. This knocked-off playing piece will be moved to the lowest level 17 of the pyramid face 11 up which such playing piece 19 had been ascending. The player whose playing piece 19 has been knocked off chooses the best spot on the lowest level 17 to place the knocked-off playing piece 17.

For as long as a player has playing pieces 19 that may be moved, the player must move any one of them according to the roll of the die. The player retains the discretion which one of such playing piece 19 he or she chooses to move.

The player has to get all of his or her playing pieces 19 up one face 11 of the pyramid and then down each of the remaining pyramid faces 11, so that each one of the remaining faces 11 has one of the player's playing pieces 19 at any spot on the lowest level 17 of such face 11. The first player to do so wins.

Variations to the game include requiring that knocked-off playing pieces are returned to specific depressions on the lowest level 17 of the pyramid face 11 the same playing piece has to ascend. Similarly, the descending playing pieces may, as a variation, be required to rest at specific depressions on the lowest levels of the respective pyramid faces down which the respective playing piece descended.

Use of Cards

There are four stacks of cards, each comprising ten cards of a particular color code. The color codes correspond to the same color codes for the playing pieces of the players.

Each stack is assigned to one player.

Each player draws randomly five out of the ten cards face down from the stack allocated to him.

The playing cards are as follows:

Peak Immunity Card—This card is used by a player with a peak playing piece against another player who moves his own playing piece to knock off the peak playing piece. The card allows the first player to keep his peak playing piece at the peak 14, while the second player's playing piece will be knocked off instead and returned to the lowest level 17 of the face of the pyramid the knocked-off playing piece was ascending. No die is to be rolled. The player using the card does not use up his turn.

Peak Immunity Shield Card—This card is used only in response to another player's Peak Immunity Card and has the effect of canceling out the effect of a Peak Immunity Card. The Peak Immunity Shield card results in the peak playing piece of the player being knocked off. No die is to be rolled.

Sliding Down Immunity Card—This card is used by a player to prevent his playing piece 19 that is sliding down the face 11 of the pyramid from being knocked out by another playing piece that may be ascending or descending. No die is to be rolled. The player using the card uses up his turn.

Jump/Left to Corresponding Spot on Pyramid Face Card—This card is used to move a playing piece 19 that is ascending the face 11 of a pyramid to a corresponding depression on an adjacent pyramid face to the left or right. The playing piece 19 can only be used for a playing piece 19 that is on or above the sixth level from the lowest level 17 of the pyramid face 11. The playing piece 11, after being moved to an adjacent pyramid face, continues its way down the face of the adjacent pyramid face in subsequent play. A playing piece 19 from a color group cannot be moved to an adjacent face 11 that already has a playing piece 19 from the same color group. The player using the card uses up his turn. No die is to be rolled.

Add One Step in Any Direction Card (before or after moving forwards on die)—After rolling the die and moving the chosen playing piece 19 in the usual way, this card may be used to move the same playing piece 19 one more step, but in any direction (forwards, backwards or sideways). The step in any direction may be taken before or after the forwards movement on the die. The card may be used even though the movement of the playing piece results in the playing piece bouncing back from the peak or the base level of a pyramid face.

Add Two Steps Forwards Card (after moving forwards on die)—After rolling the die and moving the chosen playing piece in the usual way, this card may be used to move the same playing piece 19 one more step but in any direction (forwards, backwards or sideways).

Move Three Steps in Any Direction Card (forwards, backwards or sideways or combination)—This card is used without rolling the die. The player uses up his or her turn by using the card and moves the playing piece three steps in any direction or a combination of directions. This card cannot be used to move the playing piece such that it bounces back from the peak or the base level of a pyramid face.

Blank Card (three in total)—These have no effect whatsoever.

Only one card may be used for each player's turn. The player may use, but is not obliged to use any one of the cards. Cards used cannot be reused.

In deciding to use any card, the player must strictly follow the directions. Some cards can only be used without the roll of the die, and some only after the roll of the die. When a player rolls the die, he cannot use any of the cards that can only be used without the roll of the die. The player may choose to use any card that refers to movement of the playing piece based on the roll of the die.

The blank cards cannot be used, but each player does not know how many blank cards the other players may have drawn.

A variation to the game is to allow each player to re-draw two additional cards once each player uses up to three cards. The three used cards cannot be re-drawn.

Another variation of the game is that knocked-off playing pieces must be placed at specific locations on the lowest terraced level.

Another variation of the game is that descending playing pieces must rest on specific locations on the lowest terraced level on the descending pyramid face.

Another variation of the game is that the players get a chance to re-draw two additional cards once they use up to three cards. The same three cards cannot be re-drawn.

Another variation of the game is that the playing pieces can be of different "strengths", in that one playing piece of a particular "strength" cannot knock off another playing piece of lower "strength".

Another variation of the game is that two tokens of any color may be on the truncated peak at the same time, but not more than two, so that a third token can knock off both tokens from the peak.

Another variation of the game is that each player can be allocated tokens that are the multiple of 3.

Another variation of the game is that there can be three-dimensional alternative paths to go from one face to another face without scaling the peak.

Another variation of the game is that a story can be created, along with accompanying character tokens for the story.

Another variation of the game is that the number of playing pieces per player can also be varied.

While preferred embodiments of the invention have been shown and described, various modifications and substitutions may be made thereto without departing from the spirit and scope of the invention. Other variations and modifications may suggest themselves to a person skilled in the relevant arts.

Accordingly, it is to be understood that the present invention has been described by way of illustration only, and this description should not be construed as limiting to the several claims appended hereto.

What is claimed is:

1. A game for a plurality of players, said game comprising:

a game board that depicts a pyramid having at least four equal sides, wherein each face comprises a plurality of terraced levels, including a lowest terraced level, and wherein the apex of the pyramid is a level plane or peak;

a plurality of playing pieces which are shaped as tear drops with an elongated tip, divided into a number of groups equal to the number of pyramid sides;

wherein the number of playing pieces in each group of playing pieces is one less than the number of pyramid sides;

a die, such that each playing piece is moved based on a roll of the die; and a trough separating any two adjacent sides of the pyramid, and a receptacle at a lower end of the trough;

wherein said trough extends from a corner of the truncated peak of the pyramid to a base corner of the pyramid.

2. The game according to claim 1, further comprising a plurality of cards equal in number, and divided into groups equal to the number of pyramid sides.

3. The game according to claim 1, wherein each player selects a color and is assigned playing pieces of the same color, and each player randomly draws an equal number of cards that is less than the total number of cards from the group of cards bearing the same color.

4. The game according to claim 1, wherein the lowest terraced level of each face corresponds in height to the lowest terraced levels of the other sides.

5. The game according to claim 1, wherein each correspondingly higher terraced level of each face corresponds in height to the correspondingly higher terraced level of the other sides.

6. The game according to claim 1, wherein each terraced level of each face has identical height and width.

7. The game according to claim 1, wherein the lowest terraced level for each face comprises eighteen depressions, a level above the lowest terraced level has two less depressions than the lowest terraced level, and each successively higher terraced level has two less circular depressions than the terraced level immediately below, until at the highest level, immediately below the truncated peak, there are only two depressions.

8. The game according to claim 1, wherein the game board is three-dimensional.

9. The game according to claim 1, wherein the game board is conical shaped or a 5- to 6-sided pyramid.

10. The game according to claim 1, further comprising a Peak Immunity Card.

11. The game according to claim 1, further comprising a Peak Immunity Shield Card.

12. The game according to claim 1, further comprising a Sliding Down Immunity Card.

13. The game according to claim 1, further comprising a Jump/Left to Corresponding Spot on Pyramid Face Card.

14. The game according to claim 1, further comprising an Add Two Steps Forwards Card.

15. The game according to claim 1, further comprising a Move Three Steps in Any Direction Card.

16. The game according to claim 1, further comprising a Blank Card.

17. The game according to claim 1, wherein the playing pieces have different "strengths".

18. The game according to claim 1, game according to claim 1, wherein a trough extends from each corner of the truncated peak of the pyramid to a base corner of the pyramid.

* * * * *